US005412457A

United States Patent [19]

Kawano et al.

[11] Patent Number: 5,412,457

[45] Date of Patent: May 2, 1995

[54] CONTROL OF TORQUE APPLICATION IN ELECTROPHOTOGRAPHIC COLOR IMAGING APPARATUS

[75] Inventors: Yuzo Kawano, Ogori; Hirofumi Ihara, Fukuoka, both of Japan

[73] Assignee: Matsushita Electric Industrial Co., Ltd., Osaka, Japan

[21] Appl. No.: 153,508

[22] Filed: Nov. 17, 1993

[30] Foreign Application Priority Data

Jan. 18, 1993 [JP] Japan ..... 5-005891

[51] Int. Cl.[6] ..... G03G 15/06

[52] U.S. Cl. ..... 355/245; 355/326

[58] Field of Search ..... 355/211, 210, 245, 260, 355/204, 208, 326, 327, 328; 74/63, 434

[56] References Cited

U.S. PATENT DOCUMENTS

| | | | |
|---|---|---|---|
| 4,801,966 | 1/1989 | Ikeda | 355/245 |
| 4,970,561 | 11/1990 | Mizuno | 355/326 |
| 5,138,398 | 8/1992 | Yamada | 355/326 |
| 5,146,279 | 9/1992 | Seyfried | 355/245 X |
| 5,172,168 | 12/1992 | Satoh et al. | 355/245 |

*Primary Examiner*—A. T. Grimley
*Assistant Examiner*—Sandra L. Brasé
*Attorney, Agent, or Firm*—Lowe, Price, LeBlanc & Becker

[57] ABSTRACT

An electrophotographic printing apparatus is provided. This printing apparatus includes a photosensitive medium designed to form thereon an electrostatic latent image, a developing roller designed to tone the electrostatic latent image with a toner to form a toner image on the photosensitive medium, a driving mechanism for driving the developing roller for rotation, a transport mechanism for moving the developing roller into engagement and disengagement with and from the photosensitive medium for the formation of the toner image thereon, and a control unit adapted to control the driving mechanism to rotate the developing roller immediately before the developing roller is brought by the transport mechanism into engagement with the photosensitive medium, and controls the driving mechanism to stop the developing roller from rotating immediately after the developing roller is moved by the transport mechanism away from the photosensitive medium.

20 Claims, 10 Drawing Sheets

CONTROL OF TORQUE APPLICATION IN ELECTROPHOTOGRAPHIC COLOR IMAGING APPARATUS

BACKGROUND OF THE INVENTION

1. Technical Field of the Invention

The present invention relates generally to an electrophotographic color imaging apparatus which is designed to superimpose two or more single color toner images to form a multicolor composite image on a sheet of transfer paper.

2. Background Art

In recent years, electrophotography using dry toner materials has become used most widely in electrophotographic printing arts, and is put to practical use in copying machines or laser beam printers.

In conventional electrophotographic color printers, an exposure beam for each color is radiated onto a photosensitive medium having a photosensitive layer thereon to form a plurality of electrostatic latent images which are, in turn, toned with different color toners, respectively and then transferred to a sheet of transfer paper to create a multicolor image.

U.S. Pat. No. 4,652,115 and Japanese Patent First Publication No. 63-292156 teach a conventional electrophotographic color printer wherein an intermediate transfer medium is provided between a photosensitive medium and a transfer paper feeding path so that toner images formed on the photosensitive medium are superimposed on the intermediate transfer medium to form a composite image which is, in turn, transferred onto a sheet of transfer paper.

Hereinafter, an example of conventional electrophotographic color printer will be explained with reference to FIGS. 7 to 11.

The shown electrophotographic color printer includes a photosensitive medium 2 provided with an endless resinous belt on which a photosensitive film made of selenium (Se) or organic photoconductive (OPC) materials is formed, an exposure roller 3, a drive roller 4, a tension roller 5 all of which support the photosensitive medium 2, and an electrifier 6 which electrifies the photosensitive medium 2.

The photosensitive medium 2 defines a vertical flat surface between the exposure roller 3 and the drive roller 4 which are fixed on a chassis. The tension roller 5 provides tension to the photosensitive medium 2 outwardly in a direction shown by arrow C. The drive roller 4 moves the photosensitive medium 2 along a given path of travel in a direction shown by arrow A. Disposed around the photosensitive medium 2 are the electrifier 6, an exposure optical system 7, black (K), yellow (Y), magenta (M), and cyanogen (C) toner developing devices 8K, 8Y, 8M, and 8C, an intermediate transfer unit 9, a photosensitive medium cleaning device 10, and a discharging device 11.

The electrifier 6 includes a charging wire 12 made of such as tungsten, a metal shield plate 13, and a grid plate 14. When a high voltage of the order of 4–5 kV is applied to the charging wire 12, it will cause corona discharge to take place on the charging wire 12 so that the photosensitive medium 2 is charged uniformly through the grid plate 14.

An exposure beam 15 is provided with an image signal from a gradient converter which is light intensity-modulated or pulse width-modulated by a laser drive circuit and then radiated from a laser diode to the photosensitive medium 2 to form a single color electrostatic latent image. The developing devices 8K, 8Y, 8M, and 8C store therein different color toners, respectively and include developing roller 34K, 34Y, 34M, and 34C for discharging the color toners. The multicolor developing operations are performed by rotating cams 16K, 16Y, 16M, and 16C in sequence according to color selection signals so that the selected developing device, for example, the developing device 8K is urged into engagement with the photosensitive medium 2, while maintaining the other developing devices 8Y, 8M, and 8C away from the photosensitive medium 2.

In operation, when the cam 16K for the black toner developing device 8K is, as shown in FIG. 8, rotated 180 deg., it will cause the black toner developing device 8K to be shifted toward in a direction shown by arrow B so that the developing roller 34K engages the photosensitive medium 2. A spring 40 is provided to bias the developing device 8K in a direction indicated by arrow G into constant engagement with the cam 16K. A spring force of the spring 40 is set to a relatively lower value because increasing the spring force causes a resistance to the movement of the developing device 8K by the cam 16K to be increased, thus requiring greater driving force for the cam 16K. One end of the spring 40 is attached to the chassis of the printer, while the other end thereof is connected to the developing device 8K through a stopper 35. A sensor 36 is provided to monitor position of the stopper 35.

The developing roller 34K is rotated by rotating a developing roller gear 37 mounted on an end thereof through a clutch gear 38 with a drive motor (not shown). The clutch gear 38 also provides torque to a toner hopper 100K, as shown in FIG. 7, to carry a toner in the developing device 8K to the developing roller 34K.

Referring back to FIG. 7, the Intermediate transfer unit 9 includes an intermediate transfer belt 17 provided with an endless loop made of a conductive resin, an intermediate transfer belt drive roller 18 supporting the transfer belt 17, an intermediate transfer belt transfer roller 19, an intermediate transfer belt tension roller 20, and an intermediate transfer roller 21. The intermediate transfer belt tension roller 20 is urged outwardly in a direction shown by arrow D. The intermediate transfer roller 21 is arranged to hold the photosensitive medium 17 together with the transfer belt 17. The drive roller 18 is driven by the drive motor to move the transfer belt 17 in a direction shown by arrow E. A reference position sensor 22 is arranged to detect an intermediate transfer belt reference mark provided with such as a slit formed in an end of the intermediate transfer belt 17 to determine a reference position thereof. An intermediate transfer belt cleaning device 23 is disposed adjacent the drive roller 18 to remove a superfluous toner left on the transfer belt 17, and is designed to remain separate from the transfer belt 17 during formation of a composite image of each color on the transfer belt 17 and engages the transfer belt 17 only when cleaning it. A transfer paper cassette 24 stores therein a stack of sheets of transfer paper 25. A paper feeding roller 26 carries a sheet of transfer paper 25 from the transfer paper cassette 24 toward a paper transport path 27. A register roller 28 engages a compliance roller 29 and serves to stop transport of the transfer paper 25 temporarily to bring it into registration with the composite image formed on the intermediate transfer belt 17. A transfer roller 30 serves to transfer the composite image on the transfer belt 17 onto the transfer paper 25 and is designed to rotate only during transfer in contact with the transfer belt 17. A fixing device 31 includes a heat roller 32 having therein a heat source and a press roller 33 which hold therebetween the transfer paper 25 to fix the composite image on the transfer paper under heat and pressure so that a desired multicolor image is formed.

An image-transferring operation will be described below.

The photosensitive medium 2 and the intermediate transfer belt 17 are driven by the drive motor respectively at a constant speed, matching a peripheral speed with each other. The reference mark of the intermediate transfer belt 17 is detected by the reference position sensor 22 to determine an image-forming area on the transfer belt 17.

In the above condition, a high-voltage on the order of −4 kV to −5 kV is applied to the charging wire 12 of the electrifier 6 to produce corona discharge so that a surface of the photosensitive medium 2 is charged uniformly at a voltage on the order of −700 kV. Subsequently, the photosensitive medium 2 is rotated in the direction A, and the exposure beam 15 which is provided with a laser beam corresponding to one (e.g., black) of multiple colors, is radiated onto the uniformly-charged photosensitive medium 2. On a portion of the photosensitive medium 2 which is exposed to the exposure beams, a charge disappears so that a latent image is formed. The timing where the formation of the latent image is initiated is determined by a signal from the reference position sensor 22.

The black toner developing device 8K is brought into contact with the photosensitive medium 2 urged in the direction B, as shown in FIG. 8, according to rotation of the cam 16K after a period of time following detection of the reference mark on the intermediate transfer belt 17 by the reference position sensor 22. Just before this contact, a negative voltage of the order of −300 kV is applied to the developing roller 34K disposing a toner on its surface. This is because the provision of the negative voltage on the toner allows only a portion of the photosensitive medium 2 from which a charge disappears due to the radiation of the exposure beam 15 to be deposited with the toner. After completion of the developing operation, the developing device 8K is shifted away from the photosensitive medium 2 in the direction G according to 180 deg. of rotation of the cam 16K. The toner image formed on the photosensitive medium 2 by the developing device 8K is transferred to the intermediate transfer belt 17 by applying a high voltage of the order of +800 kV to the intermediate transfer roller 21 for every color.

The remainder of the toner which has not been transferred from the photosensitive medium 2 to the intermediate transfer belt 17, is removed by a cleaning blade **10*a* provided in the photosensitive medium cleaning device 10, and a charge on the photosensitive medium 2 is removed by the discharging device 11**.

Subsequently, upon selection of the cyanogen (C), the cam 16C is rotated to press the cyanogen toner developing device 8C against the photosensitive medium 2 so that the photosensitive medium 2 is toned with a cyanogen toner. In the case of an electrophotographic color printer using four color toners, the above mentioned developing operation is sequentially repeated four times so that black, yellow, magenta, and cyanogen toner images are superimposed to form a composite toner image on the intermediate transfer belt 17.

The transfer paper 25 is carried from the transfer paper cassette 24 along a transfer paper feeding path 27 and then is stopped at the register roller 28 for controlling operational timing where a composite image is transferred. After the transfer roller 30 is brought into contact with the intermediate transfer belt 17 and a high-voltage of the order of +1000 V is applied to the transfer roller 30, the composite toner image formed on the intermediate transfer belt 17 is timed by the register roller 28 to be transferred under pressure to the transfer paper being carried at a time.

Any residual toner which may be left on the intermediate transfer belt 17 without being transferred to the transfer paper 25 is removed by the transfer belt cleaning device 23. The composite image-transferred transfer paper 25 is fed to the fixing device 31 so that the composite image is fixed under heat of the heat roller 32 and pressure of the press roller 33 to form a multicolor image.

The transfer belt cleaning device 23 remains separate from the intermediate transfer belt 17 until the composite image has been transferred to the transfer paper 25.

With the above image-transferring operation, the multicolor image is recorded on a sheet of transfer paper completely.

Hereinbelow, engagement and disengagement of the developing device 8K with and from the photosensitive medium 2 will be discussed with reference to FIGS. 9 to 11.

The developing device 8K in a standby state, as shown in FIG. 10(*a*), is responsive to rotation of the cam 16K to move toward the photosensitive medium 2 at a time P, as shown in FIG. 9, prior to a time N at which a leading edge of the image transferred onto the photosensitive medium 2 reaches the developing device 8K. The developing roller 34K, as shown in FIG. 10(*b*), then engages the photosensitive medium 2. The cam 16K stops rotating upon the sensor 36 detecting a slit formed on the developing device 8K at a time Q following a time L at which the developing roller 34K engages the photosensitive medium 2 after which the developing roller 34K, as shown in FIG. 10(*c*), begins to rotate at a time T.

The developing roller 34K stops rotating in engagement with the photosensitive medium 2, as shown in FIG. 11(*b*), at a time U after a time O at which a trailing edge of the image formed on the photosensitive medium 2 passes over the developing roller 34K. Subsequently, the cam 16K begins to rotate at a time R, the developing roller 34K is, as shown in FIG. 11(*c*), disengaged from the photosensitive medium 2, the sensor 36 detects the absence of the slit provided on the developing device 8K in a detecting range, and then the cam 16K stops rotating, a sequence of disengagement operations thereby terminating.

The above described prior art arrangements, however, encounters the following drawbacks. At a time when the developing roller 34K engages the photosensitive medium 2, the developing roller 34K does not yet start to rotate, thus causing a toner layer formed on a surface of the developing roller 34 to be stripped by a surface of the traveling photosensitive medium 2. This can lead to direct contact of the developing roller 34 with the photosensitive medium 2, causing friction to create between the developing roller 34K and the photosensitive medium 2. This results in a change in traveling speed of the photosensitive medium 2. Thus, in the event that a latent image is being formed by the radiation of the exposure beam 15, it may be disturbed, resulting in quality of an output image being degraded.

To eliminate the above problem, if the developing roller 34K is made to rotate before engagement with the photosensitive medium 2, that is, at a location distant from the photosensitive medium 2, another problem is raised in that in the case where the clutch gear 38 is located above the developing roller gear 37, as shown in the drawings, the torque of the clutch gear 38 which essentially serves to rotate the developing roller gear 37 also acts on the developing device 8K through the developing roller gear 37 and its support shaft to urge it toward the photosensitive medium 2 against a biasing force of the spring 40, thereby causing the developing roller 34K to hit the photosensitive medium 2 hard. This can lead to vibrations, resulting in latent images being disturbed with the degradation of quality of output images.

In addition, even when the developing roller 34K is made to disengage from the photosensitive medium while being maintained rotating, In the case where the clutch gear 28 is arranged above the developing roller gear 37, the developing device 8K is maintained urged toward the photosensitive medium 2 during a time when the developing roller 34K is driven to rotate. Upon stopping the developing roller 34k from rotating, the developing device 8K is suddenly shifted toward the cam 16 due to the biasing force of the spring 40, causing vibrations to occur which may affect the formation of the latent images.

Further, in the case where the clutch gear 38 is arranged below the developing roller gear 37, the torque of the clutch gear 38 also acts to urge the developing device 8K in a direction opposite the photosensitive medium 2. This produces a resistance to the movement of the developing device 8K by the cam 16K, thus requiring more torque to drive the cam 16K for displacing the developing device 8K toward the photosensitive medium 2. Accordingly, a large drive motor is needed, resulting in the system becoming bulky with increased power consumption.

SUMMARY OF THE INVENTION

It is therefore a principal object of the present invention to avoid the disadvantages of the prior art.

It is another object of the present invention to provide an electrophotographic color printer which is designed to prevent electrostatic latent images from being disturbed during a toner image developing operation for assuring high-quality multicolor images.

According to one aspect of the present invention, there is provided an electrophotographic printing apparatus which comprises a photosensitive medium designed to form thereon an electrostatic latent image, a developing roller designed to develop the electrostatic latent image formed on the photosensitive medium, a driving means for driving the developing roller for rotation, a moving means for moving the developing roller into engagement and disengagement with and from the photosensitive medium, and a controlling means for providing a first control signal to the driving means to rotate the developing roller during a time when the moving means is operated to move the developing roller toward the photosensitive medium, the controlling means also providing a second control signal to the driving means to stop the developing roller from rotating during a time when the moving means is operated to move the developing roller away from the photosensitive medium.

With the above arrangements, the driving means is made to start to rotate the developing roller immediately before the developing roller is brought by the moving means into engagement with the photosensitive medium, and is also made to stop the developing roller from rotating immediately after the developing roller is moved by the moving means away from the photosensitive medium. Therefore, there is almost no impact when the developing roller engages the photosensitive medium and when the developing roller engage the moving means, which can leads to vibrations affecting the quality of an image to be formed.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
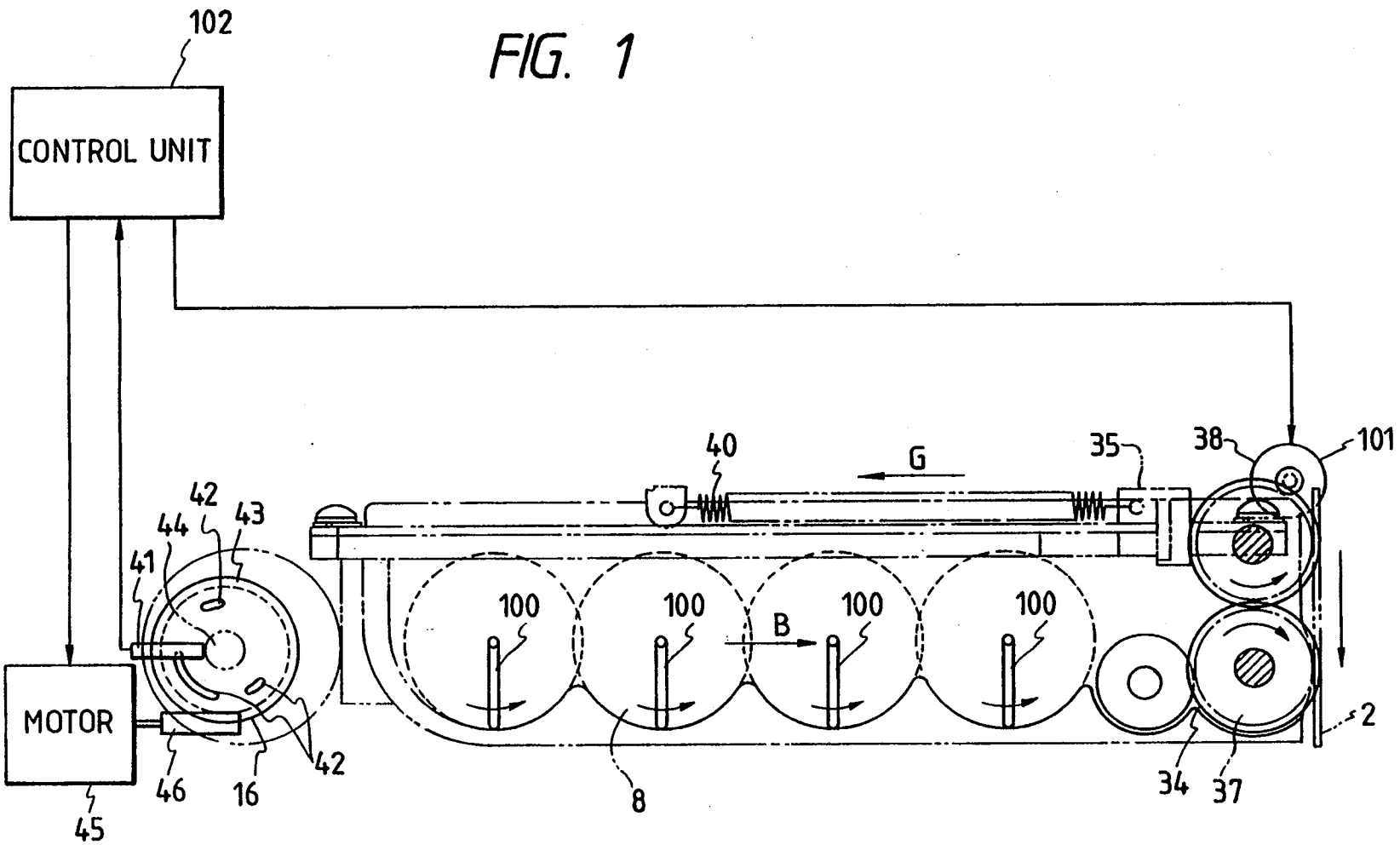
FIG. 1 is a sectional view which shows a developing device transport mechanism according to the present invention which is incorporated in an electrophotographic multicolor printer.
Figure 7:
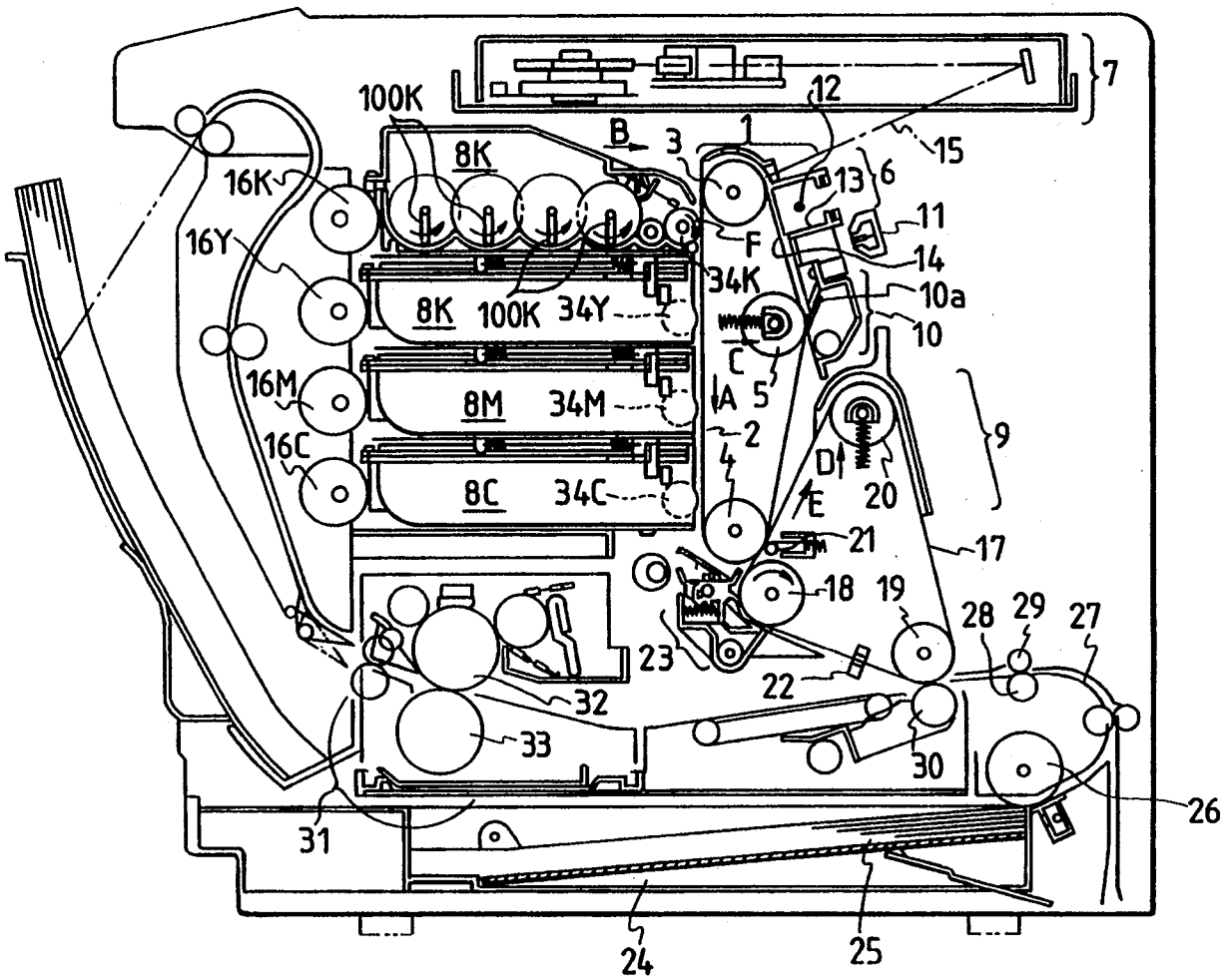
FIG. 7 PRIOR ART
FIG. 7 is a cross-sectional view which shows a conventional electrophotographic color printer.
Figure 8:
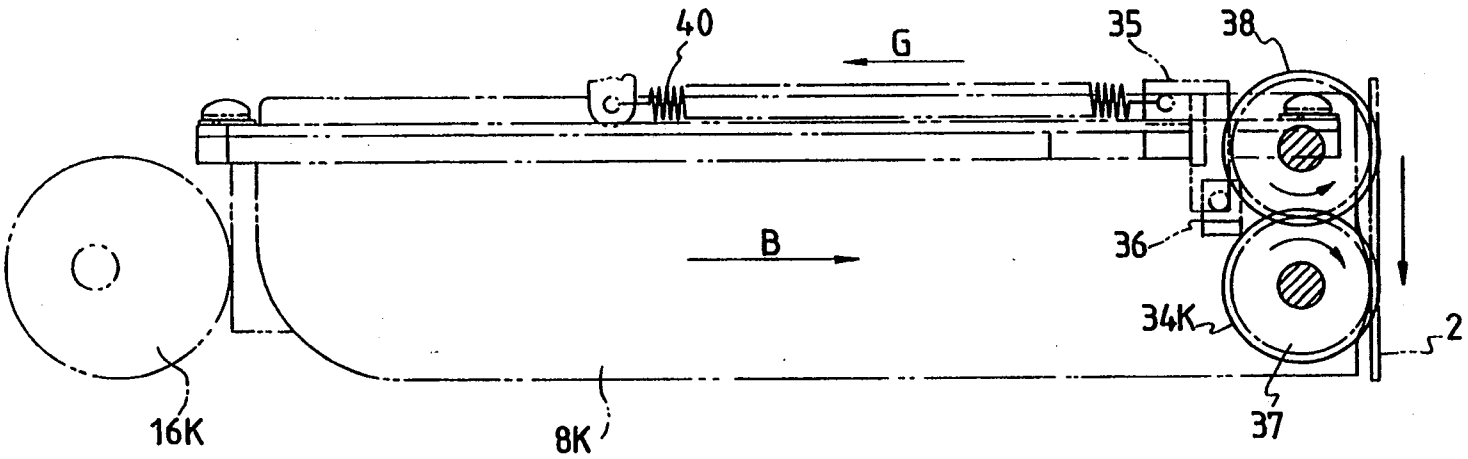
FIG. 8 PRIOR ART
FIG. 8 is a sectional view which shows a developing device transport mechanism which is incorporated in a conventional electrophotographic color printer, as shown in FIG. 7.
Figure 9:
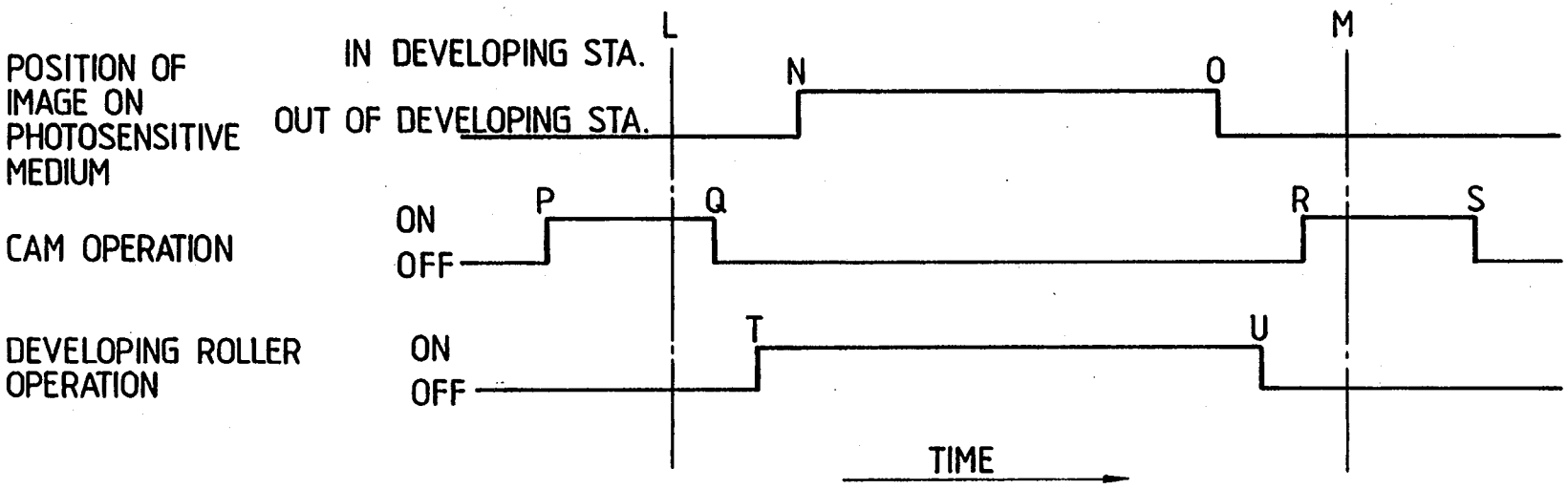
FIG. 9 PRIOR ART
FIG. 9 is a timing chart which shows a positional relation among an image formed on a photosensitive medium, a cam urging a developing device toward a photosensitive medium, and a developing roller in a conventional electrophotographic color printer, as shown in FIG. 7.
Figures 10A, 10B, 10C:
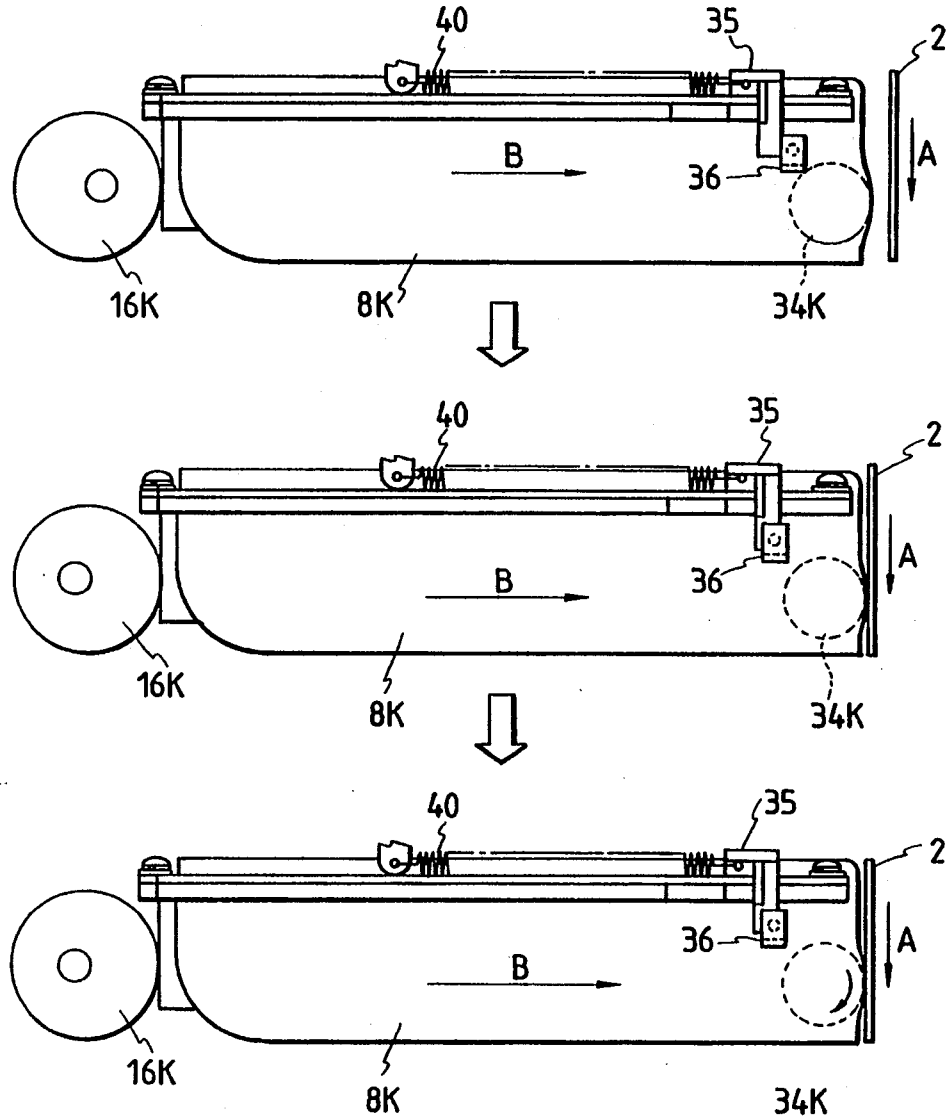
FIGS. 10(*a*), 10(*b*), and 10(*c*) are illustrations which respectively show a positional relation between a developing roller and a photosensitive medium in a conventional electrophotographic color printer, as shown in FIG. 7 when the developing roller is urged by a cam into engagement with the photosensitive medium.
Figures 11A, 11B, 11C:
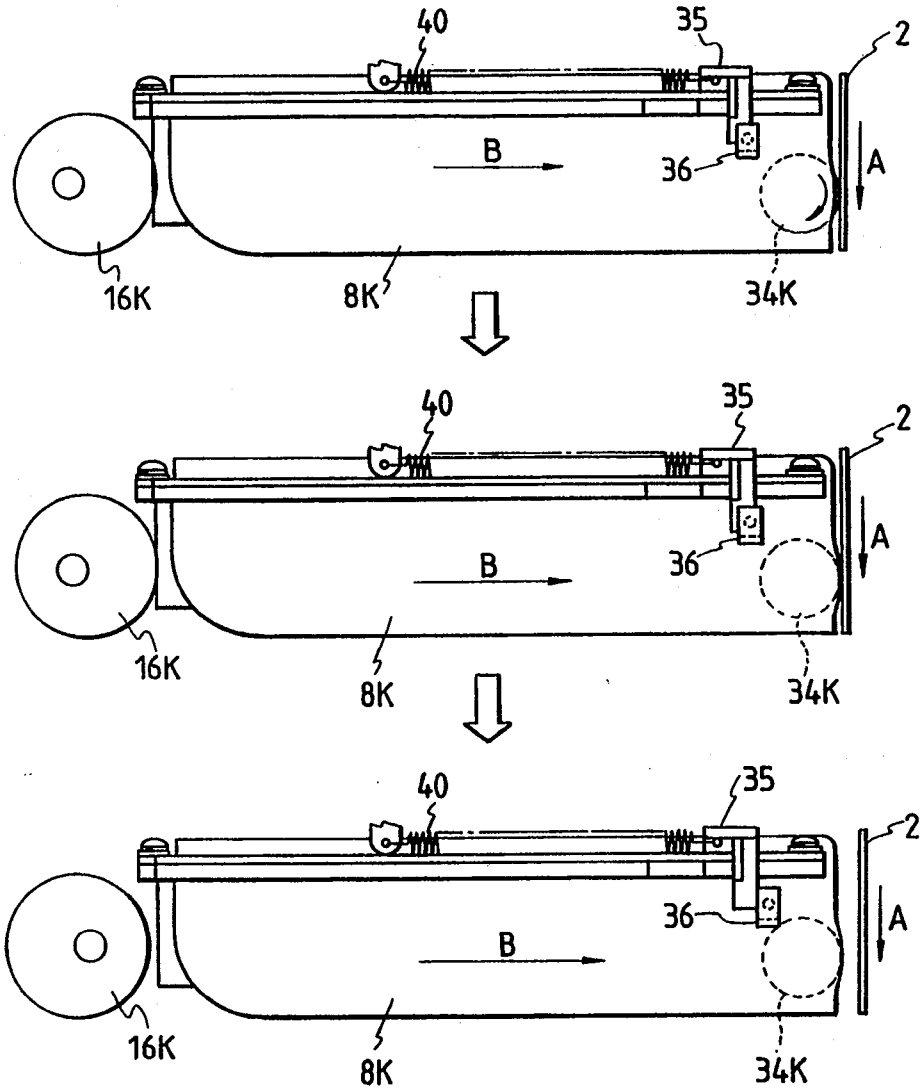
FIGS. 11(*a*), 11(*b*), and 11(*c*) are illustrations which respectively show a positional relation between a developing roller and a photosensitive medium in a conventional electrophotographic color printer, as shown in FIG. 7, when the developing roller is urged by a cam into disengagement from the photosensitive medium.

Referring now to the drawings, particularly to FIG. 1, there is shown a developing device transport system according to the present invention which may be incorporated in an electrophotographic color printer of the type, as discussed in the introductory part of the present application, whose arrangements form part of the present invention. The shown developing device transport system of the invention is practically provided for every developing device (e.g., in the arrangement, as shown in FIG. 7, including four developing devices, four developing device transport systems are provided), however, only one will be discussed below for the sake of simplicity of disclosure. In the following discussion, the same numbers refer to the same parts as shown in FIGS. 7 to 11, and explanation thereof in detail will be omitted here.

The electrophotographic color printer, as already explained in the introductory part of the present application, includes generally a photosensitive medium 2 designed to form thereon electrostatic latent images, a developing device 8, a cam 16, a spring 40, and a developing roller 34. The photosensitive medium 2 is made of an endless resinous belt on which a photosensitive film made of selecium (Se) or organic photoconductive (POC) materials, is formed. The developing device 8 is designed to tone the electrostatic images formed on the photosensitive medium 2 with a toner. The spring 40 serves to bias the developing device 8 in a direction shown by arrow G into constant engagement with the cam 16. A spring force of the spring 40 is set to a relatively lower value because increasing the spring force of the spring 40 causes a resistance to movement of the developing device 8 by the cam 16 to be increased, thus requiring greater driving force for the cam 16K. One end of the spring 40 is attached to a chassis of the printer while the other end thereof is connected to the developing device 8 through a stopper 35. The developing roller 34 serves to deposit a toner on the photosensitive medium 2 which is uniformly charged, and is rotatably supported by the developing device 8 through a support shaft. The developing roller gear 37 is mounted on an end of the support shaft of the developing roller 34 for transmitting torque to the developing roller 34 from the clutch gear 38. The clutch gear 38 is rotatably supported by the chassis of the printer. With this arrangement, when a drive motor 101 is activated, it will cause the clutch gear 38 to rotate, thereby rotating the developing roller 34 through the developing roller gear 37. The clutch gear 38 also transmits the torque to toner hoppers 100 which carry a toner stored in the developing device 8 toward the developing roller 34.

Figure 2:
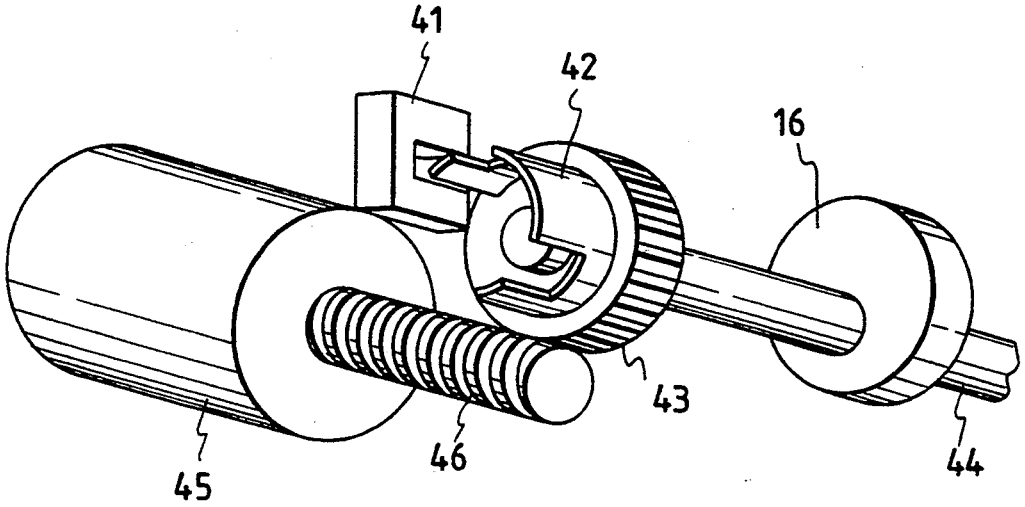
FIG. 2 is a perspective view which shows an arrangement designed to detect an angular position of a cam which urges a developing device toward a photosensitive medium.

The cam 16, as shown in FIG. 2, is supported by a cam shaft 44 which is connected to the chassis of the printer at an end thereof. Mounted on the other end of the cam shaft 44 is a worm wheel 43 which includes an extending portion 42, as will be described hereinafter in detail, on an end surface thereof. The rotation of a worm 46 secured on an output shaft of a cam motor 45 causes the worm wheel 43 to rotate, thereby rotating the cam 16. A sensor is arranged to detect the extending portion 42 provided on the worm wheel 43 for determining angular position of the cam 16, and provides a signal indicative thereof to a control unit 102. The control unit 102 then controls operations of the cam motor 45 and the drive motor 101, as will be described hereinafter in detail, to adjust operational timings with which the cam 16 and the developing roller 34 start and, stop rotating.

Figure 3:
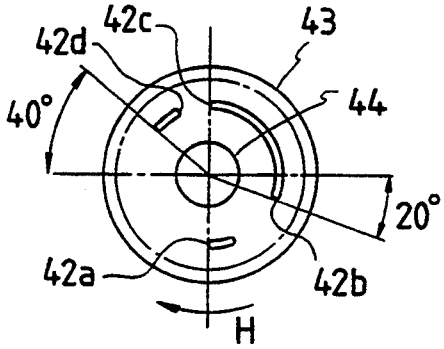
FIG. 3 is a plane view which shows an angular positional relation between extensions provided on an end surface of a worm wheel mounted coaxially with a cam which urges a developing device toward a photosensitive medium.

The extending portion of the worm wheel 43, as shown in FIG. 3, includes three extensions defining four reference extension walls 42*a*, 42*b*, 42*c*, and 42*d* between slits. When shifting the developing device 8 along a given path of travel in a direction indicated by arrow B, as shown in FIG. 1, the cam motor 45 is responsive to a control signal from the control unit 102 to rotate the cam 16 together with the worm wheel 43 in a direction shown by arrow H. The developing device 8 is displaced by the cam 16 toward the photosensitive medium 2. During the displacement of the developing device 8, or the rotation of the worm wheel 43, when the sensor detects the reference extension wall 42*a* of the worm wheel 43, the control unit 102 then activates the drive motor 101 to rotate the developing roller 34 through the clutch gear 38 and the developing roller gear 37. Subsequently, upon detecting the reference extension wall 42*b*, the control unit 102 deactivates the cam motor 45, stopping the cam 16 from rotating.

Additionally, when moving the developing device 8 in a direction shown by arrow G, the cam motor 45 further drives the cam 16 together with the worm wheel 43 in the direction H. During the rotation of the worm wheel 43, when the sensor 41 detects the presence of the reference extension wall 42*c*, it will cause the developing roller 34 to be stopped from rotating. Upon detecting the reference extension wall 42*d*, the cam motor 45 is deactivated so that the cam 16 is stopped from rotating.

The engagement/disengagement operation of the developing device 8 with and from the photosensitive medium 2 and the operation of the developing roller 34 will be discussed in detail below with reference to FIGS. 4 to 6.

When it is required to form one color separation toner image on the photosensitive medium 2, the developing device 8, as shown in FIG. 5(*a*), is urged by the cam 16 in the direction B toward the photosensitive medium 2, while the worm wheel 43 is rotated in the direction H at a time P prior to a time N where a leading edge of an image formed on the photosensitive medium reaches a developing station.

Subsequently, at a time T prior to a time L where the cam 16 brings the developing roller 34 into engagement with the photosensitive medium 2, the sensor detects the extension 42*a* so that the developing roller 34 starts to rotate, as shown in FIG. 5(*b*). Upon the rotation of the developing roller 34, the developing device is, as shown in FIG. 5(*c*), urged by the activity of the clutch gear 38 into engagement with the photosensitive medium 2 so that the developing device 8 is separated from the cam 16 against the biasing force produced by the spring 40 acting in a direction opposite the photosensitive medium, the developing roller 34 thereby engaging the photosensitive medium 2. This is because, as mentioned in the introductory part of this application, the clutch gear 38 is supported by the chassis of the printer at a location above the developing roller gear 37 (i.e., the developing roller 34) so that part of the torque of the clutch gear 38 acts to urge the developing roller 34 toward the photosensitive medium 2.

With the above arrangement, the developing device 8 is initially displaced by the cam 16 toward a given location away from the photosensitive medium at a preselected interval, and the clutch gear 38 is then rotated, thereby causing the developing device 8 to be urged away from the cam 16 into engagement with the photosensitive medium 2 while the developing roller 34 is maintained rotating. Therefore, there is almost no impact when the developing roller 34 engages the photosensitive medium 2, resulting in vibrations being reduced greatly.

Finally, when the sensor 41 detects the reference extension wall 42*b* at a time Q, the cam motor 45 is stopped from rotating so that the movement of the developing device 8 is completed, as shown in FIG. 5(*d*).

When it is required to have the single color toner image on the photosensitive medium further toned with a toner of another color, the cam 16 is rotated by the cam motor 45 in the direction H from a state, as shown in FIG. 6(*a*), so as to urge the developing device 8 In the direction G by the biasing force of the spring 40 at a time R after a time O where a trailing edge of the toner image formed on the photosensitive medium 2 passes over the developing device 8. However, since the developing roller 34 is maintained driven by the clutch gear 38, the developing device 8 is also maintained pressed against the photosensitive medium 2 so that the cam 16 is, as shown in FIG. 6(*b*), shifted away from the developing device 8 according to its rotation. In other words, the developing device does not move so that the developing roller 34 remains in contact with the photosensitive medium 8.

Figure 4:
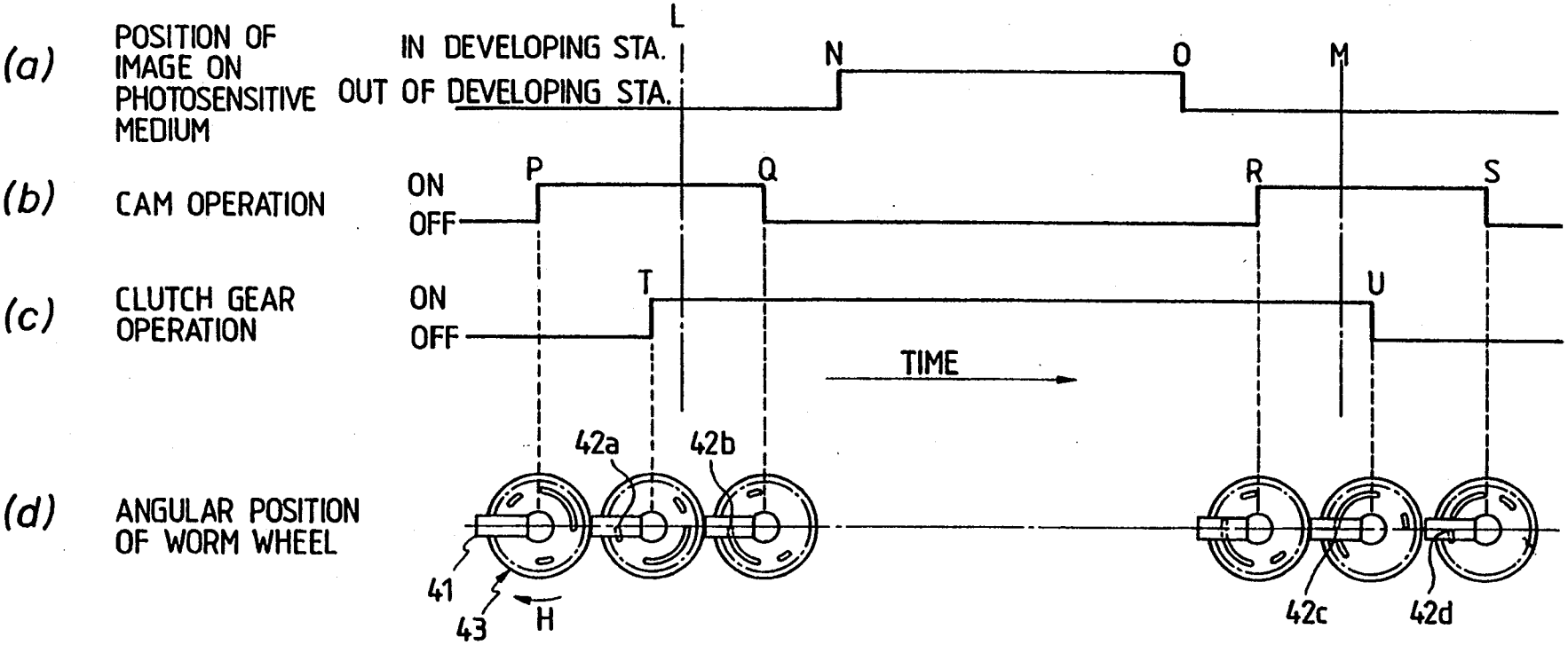
FIG. 4 is a timing chart which shows a positional relation among an image formed on a photosensitive medium, a cam urging a developing device toward a photosensitive medium, a developing roller, and extensions provided on a worm wheel mounted coaxially with the cam.
Figure 5A:
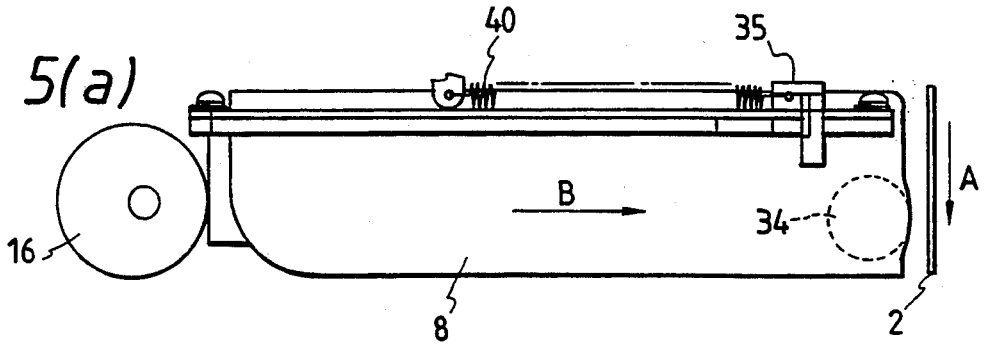
FIGS. 5(*a*), 5(*b*), 5(*c*), and 5(*d*) are illustrations which show a positional relation between a developing roller and a photosensitive medium, respectively when the developing roller is urged by a cam into engagement with the photosensitive medium.
Figure 5B:
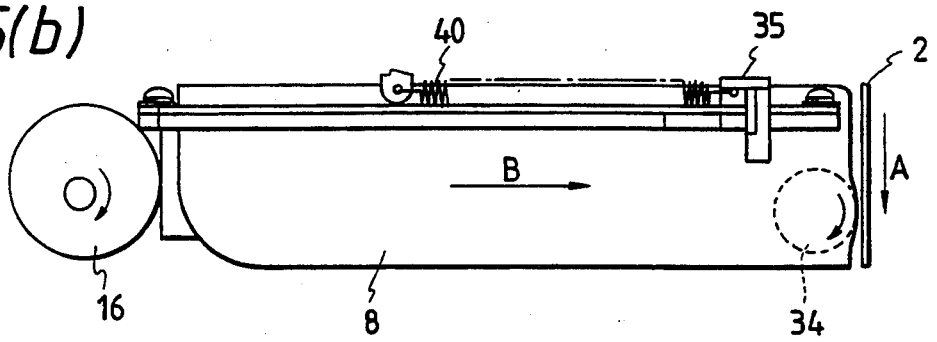
Figure 5C:
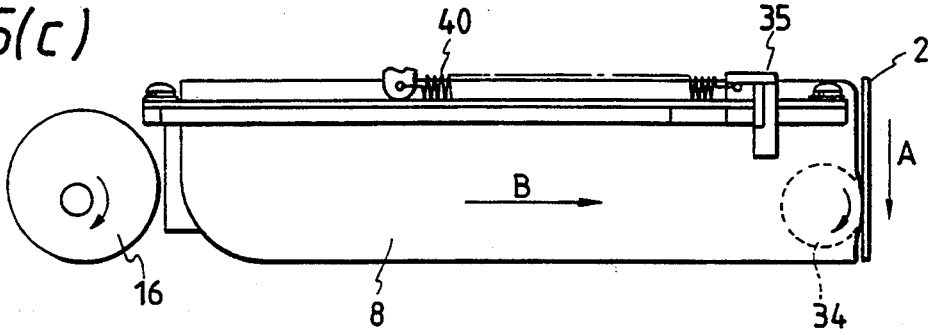
Figure 5D:
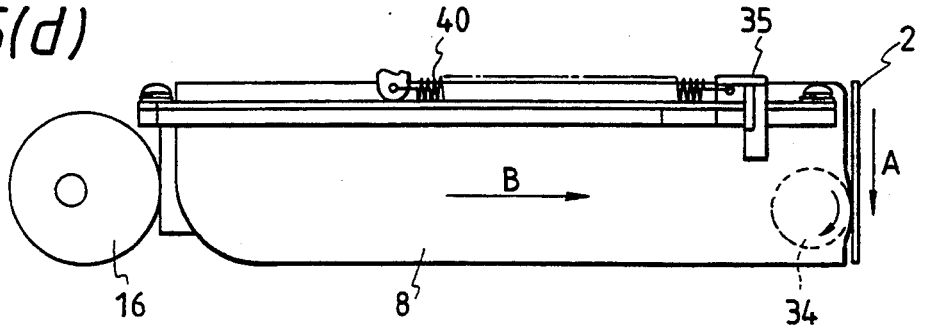
Figure 6A:
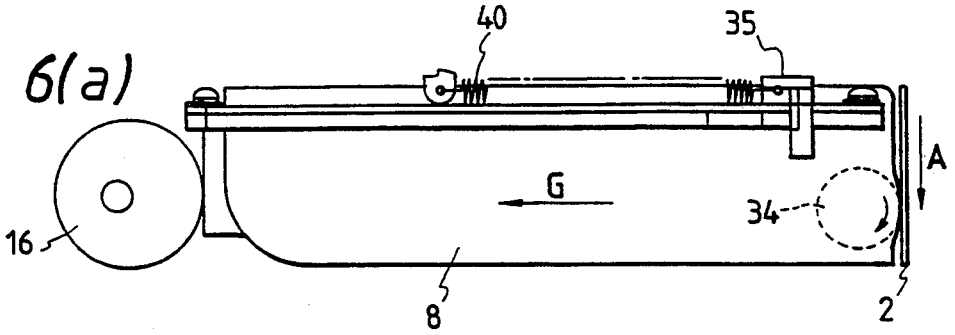
FIGS. 6(*a*), 6(*b*), 6(*c*), and 6(*d*) are illustrations which show a positional relation between a developing roller and a photosensitive medium, respectively when the developing roller is urged by a cam into disengagement from the photosensitive medium.
Figure 6B:
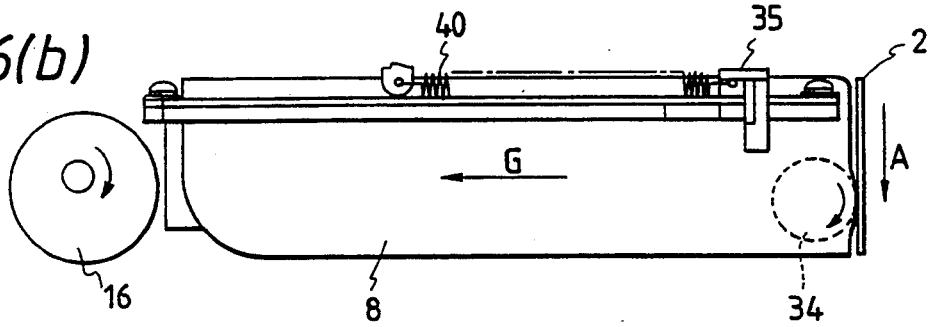
Figure 6C:
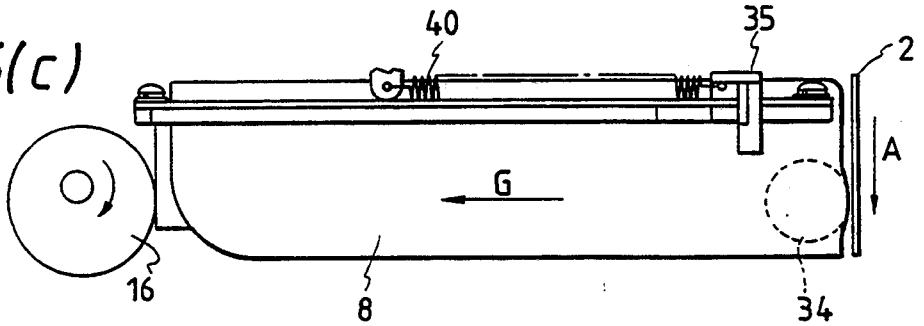
Figure 6D:
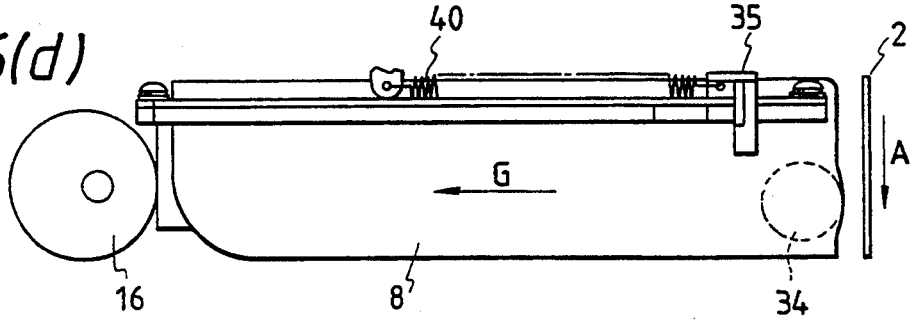

In FIG. 4, assuming that the pressure of the cam 16 acting on the developing device 8 is released at a time M, the sensor 41 detects the reference extension wall 42*c* at a time U after the time M to stop the developing roller 34 from rotating through the clutch gear 38. This causes the biasing force of the clutch gear 38 acting on the developing device 8 to urge it toward the photosensitive medium 2 to be released so that the developing roller 34 is shifted by the spring force of the spring 40 away from the photosensitive medium 2.

With the above arrangement, the clutch gear 38 is stopped from rotating immediately after the cam 16 is independently separated from the developing device 8 at the time M. The developing roller 34 is, thus, moved by the spring 40 away from the photosensitive medium 2 and the developing device 8 then comes in contact with the cam 16 from a location close to the cam 16. Accordingly, there is almost no impact which may cause vibrations to occur when the developing device 8 engages the cam 16.

Finally, when the sensor 41 detects the reference extension wall 42*d* at a time S which indicates that the developing device 8 has been returned back to an initial position, the cam motor 45 is deactivated, thereby stopping the movement of the developing device 8, as shown in FIG. 6(*d*).

As mentioned above, in the electrophotographic color printer according to the present invention, when the developing roller 34 is brought into engagement with the photosensitive medium 2, the developing roller 34 is made to rotate after having been moved to a location near the photosensitive medium 2. Therefore, while the torque of the clutch gear 38 causes the developing roller 34 to hit the photosensitive medium 2, its impact is reduced greatly as compared with a conventional printer. In addition, since the developing roller 34 is brought into contact with the photosensitive medium 2 while being maintained rotating, a toner layer formed on a surface of the developing roller 34 is not stripped by the photosensitive medium 2, thus preventing traveling speed of the photosensitive medium from changing due to direct contact of the photosensitive medium 2 with the developing roller 34. Alternatively, when the developing device 8 is turned back to an initial position from the photosensitive medium 2, the clutch gear 38 is stopped from rotating at a time when the cam 16 is slightly displaced away from the developing device 8. Therefore, similar to the above, the impact occurring when the developing device 8 is urged by the spring 40 into engagement with the cam 16 is decreased greatly.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An electrophotographic printing apparatus comprising:

a photosensitive medium designed to form thereon an electrostatic latent image;

a developing roller designed to develop the electrostatic latent image formed on said photosensitive medium;

a roller gear mounted coaxially with said developing roller;

a transmission gear arranged to transmit torque supplied from a power source to said developing roller through said roller gear;

moving means for moving said developing roller into engagement and disengagement with and from said photosensitive medium;

means for meshing said transmission gear with said roller gear after separation of said moving means from said developing roller so that the torque acts to displace said roller gear to contact said photosensitive medium; and controlling means for providing a first control signal which has said transmission gear rotate to rotate said developing roller during a time when said moving means is operating to move said developing roller toward said photosensitive medium, said controlling means also providing a second control signal which restricts the rotation of said transmission gear to stop said developing roller from rotating during a time when said moving means is operated to move said developing roller away from said photosensitive medium.

2. An electrophotographic printing apparatus comprising:

a photosensitive medium designed to form thereon an electrostatic latent image;

a developing roller designed to develop the electrostatic latent image formed on said photosensitive medium;

a roller gear mounted coaxially with said developing roller;

a transmission gear arranged to transmit torque supplied from a power source to said developing roller through said roller gear;

a developing unit supporting said developing roller rotatably, said developing unit being arranged to move along a given path of travel into engagement and disengagement with and from said photosensitive medium;

cam means for urging said developing unit toward and away from said photosensitive medium;

means for meshing said transmission gear with said roller gear after separation of said cam means from said developing unit so that the torque acts to displace said roller gear to contact said photosensitive medium; and controlling means for providing a first control signal for rotating said transmission gear to rotate said developing roller during a time when said cam means is operated to move said developing roller toward said photosensitive medium, said controlling means providing a second control signal for restricting the rotation of said transmission gear to stop said developing roller from rotating during a time when said cam means is operated to move said developing roller away from said photosensitive medium.

3. An electrophotographic printing apparatus comprising:

a photosensitive medium designed to form thereon an electrostatic latent image;

a developing roller designed to develop the electrostatic latent image formed on said photosensitive medium;

a roller gear mounted coaxially with said developing roller;

a transmission gear arranged to transmit toque supplied form a power source to said developing roller through said roller gear;

a developing unit supporting said developing roller rotatably, said developing unit being arranged to move along a given path of travel into engagement and disengagement with and from said photosensitive medium;

cam means rotatable for moving said developing unit toward and away from said photosensitive medium;

urging means for urging said developing unit away from said photosensitive medium;

angular position detecting means for detecting an angular position of said cam means to provide a signal indicative thereof; and controlling means, responsive to the signal from said angular position detecting means, for providing first and second control signals, the first control signal serving to have said transmission gear rotate to rotate said developing roller during a time when said cam means is operated to move said developing roller toward said photosensitive medium, the second control signal serving to restrict the rotation of said transmission gear to stop said developing roller from rotating during a time when said cam means is operated to move said developing roller away from said photosensitive medium.

4. An electrophotographic printing apparatus comprising:

a photosensitive medium designed to form thereon an electrostatic latent image;

a developing roller designed to develop the electrostatic latent image formed on said photosensitive medium;

a roller gear mounted coaxially with said developing roller;

a transmission gear arranged to transmit toque supplied form a power source to said developing roller through said roller gear;

a developing unit supporting said developing roller rotatably, said developing unit being arranged to move along a given path of travel into engagement and disengagement with and from said photosensitive medium;

a cam member rotatable for moving said developing unit toward and away from said photosensitive medium;

urging means for urging said developing unit away from said photosensitive medium;

first and second extensions provided on said cam member, said first extension being arranged to indicate stopping timing to have said cam member stopped from rotating, the second extension being arranged to indicate rotating timing to have said developing roller start to rotate;

detecting means for detecting said first and second extensions to provide signals indicative thereof; and controlling means, responsive to the signal from said detecting means, for providing first and second control signals, the first control signal serving to have said transmission gear rotate to rotate said developing roller during a time when said cam member is operated to move said developing unit toward said photosensitive medium, the second control signal serving to restrict the rotation of said transmission gear to stop said developing roller from rotating during a time when said cam member is operated to move said developing unit away from said photosensitive medium.

5. An electrophotographic printing apparatus comprising:

a photosensitive medium designed to form thereon an electrostatic latent image;

a developing roller designed to develop the electrostatic latent image formed on said photosensitive medium;

a developing unit supporting said developing roller rotatably, said developing unit being arranged to move along a given path of travel into engagement and disengagement with and from said photosensitive medium;

a cam member rotatable for moving said developing unit toward and away from said photosensitive medium;

urging means for urging said developing unit away from said photosensitive medium;

a roller gear mounted coaxially with said developing roller;

a transmission gear connecting between a power source and said roller gear, said transmission gear being arranged to have part of torque supplied from the power source serving to rotate said developing roller act on said roller gear to urge said developing roller toward said photosensitive medium;

first and second extensions provided on said cam member, said first extension being arranged to indicate stopping timing where said cam member is stopped from rotating, the second extension being arranged to indicate rotating timing where said developing roller is made to start to rotate;

detecting means for detecting said first and second extensions to provide signals indicative thereof; and controlling means, responsive to the signal from said detecting means, for providing first and second control signals, the first control signal serving to have said transmission gear rotate to rotate said developing roller during a time when said cam member is operated to move said developing unit toward said photosensitive medium, the second control signal serving to restrict the rotation of said transmission gear to stop said developing roller from rotating during a time when said cam member is operated to move said developing unit away from said photosensitive medium.

6. An electrophotographic printing apparatus including a photosensitive medium designed to form thereon a series of electrostatic latent images each representing a color separation of a multicolor image to be formed and a plurality of developing rollers for toning the electrostatic latent images with toners of different colors, one different color for each image, to form toner images which are superimposed to a transfer medium to form the multicolor image, which comprising;

a plurality of developing units rotatably supporting said developing rollers, respectively, each of said developing units being arranged to move along a given path of travel into engagement and disengagement with and from said photosensitive medium;

a plurality of cam members rotatable for moving said developing units toward and away from said photosensitive medium, respectively;

a plurality of urging means for urging said developing units away from said photosensitive medium, respectively;

a plurality of roller gears mounted coaxially with said developing rollers, respectively;

a plurality of transmission gears connecting between a power source and said roller gears, respectively, each of said transmission gears being arranged to have part of torque supplied from the power source for rotating said developing roller act on said roller gear to urge said developing roller toward said photosensitive medium;

a plurality of pairs of first and second extensions each pair provided on said cam member, each of said first extensions being arranged to indicate stopping timing to have said cam member stopped from rotating, each of the second extensions being arranged to indicate rotating timing to have said developing roller start to rotate;

detecting means for detecting said first and second extensions to provide signals indicative thereof; and controlling means, responsive to the signals from said detecting means, for providing first and second control signals, the first control signal serving to have each of said transmission gears rotate to rotate said developing roller during a time when said cam member is operated to move said developing unit toward said photosensitive medium, the second control signal serving to restrict the rotation of each of said transmission gears to stop said developing roller from rotating during a time when said cam member is operated to move said developing unit away from said photosensitive medium.

7. An electrophotographic printing apparatus comprising:

a photosensitive medium designed to form thereon an electrostatic latent image;

an image-toning roller designed to rotate in contact with said photosensitive medium to tone the electrostatic latent image formed on said photosensitive medium;

driving means for providing torque to said image-toning roller for rotation, said driving means being arranged to have part of the torque act on said image-toning roller to be urged toward said photosensitive medium;

moving means for moving said image-toning roller along a given path of travel toward and away from said photosensitive medium;

monitoring means for monitoring operational timing of said moving means to provide first and second timing signals, the first timing signal being provided when said moving means moves said image-toning roller toward a location away from said photosensitive medium by a given distance, the second timing signal being provided when said moving means brings said image-toning roller into engagement with sad photosensitive medium; and control means, responsive to the first timing signal from said monitoring means, for activating said driving means to urge said image-toning roller against said photosensitive medium, said control mean being also responsive to the second timing signal from said monitoring means for deactivating said moving means to maintain said image-toning roller engaging said photosensitive medium.

8. An apparatus as set forth in claim 7, wherein said monitoring means further provides a third timing signal when said moving means is positioned for moving said image-toning roller away from said photosensitive medium by a preselected distance, said control means being responsive to the third timing signal from said monitoring means to deactivate said driving means to stop said image-toning roller form rotating.

9. An apparatus as set forth in claim 8, wherein said moving means is provided with a cam member which is rotatable to displace said image-toning roller into engagement and disengagement with and from said photosensitive medium.

10. An apparatus as set forth in claim 9, wherein said monitoring means monitors an angular position of said cam member.

11. An apparatus as set forth in claim 10, wherein said cam member includes first, second, and third reference extension walls, said monitoring means detecting the first, second, and third reference extension walls to provide the first, second, and third timing signals, respectively.

12. An apparatus as set forth in claim 11, wherein said third timing signal is provided when said cam member rotates at a given angle for bringing said image-toning roller into disengagement from said photosensitive medium.

13. An apparatus as set forth in claim 8, wherein said monitoring means further provides a fourth timing signal when said moving means moves said image-toning roller toward an initial location, said control means being responsive to the fourth timing signal from said monitoring means to deactivate said moving means.

14. An electrophotographic printing apparatus comprising:

a photosensitive medium designed to form thereon an electrostatic latent image;

an image-toning roller designed to rotate in contact with said photosensitive medium to tone the electrostatic latent image formed on said photosensitive medium;

driving means for providing torque to said image-toning roller for rotation;

moving means for moving said image-toning roller along a given path of travel toward and away from said photosensitive medium; and control means for activating said driving means to rotate said image-toning roller when said moving means brings said image-toning roller to a predetermined position at a predetermined distance from said photosensitive medium.

15. An apparatus as set forth in claim 14, wherein said control means deactivates said moving means when said image-toning roller engages said photosensitive medium.

16. An apparatus as set forth in claim 15, wherein said control means deactivates said driving means to stop said image-toning roller from rotating after said image-toning roller is moved away from said photosensitive medium by a preselected distance.

17. An apparatus as set forth in claim 14, wherein said moving means is provided with a rotatable cam member for displacing said image-toning roller into and out of engagement with said photosensitive medium.

18. An apparatus as set forth in claim 14, wherein:

said moving means applies first moving force to said image-toning roller, said driving means applies second moving force to said image-toning roller upon providing torque thereto, said first and second moving forces acting for moving said image-toning roller along said given path, and said control means operates for activating said driving means to apply said torque and said second moving force to said image-toning roller at said predetermined distance from said photosensitive medium.

19. An apparatus as set forth in claim 18, wherein said control means operates for activating said driving means to apply said torque and said second moving force at said predetermined location while said moving means moves said image-toning roller towards the photosensitive medium, for separating a structure carrying said image-toning roller from said moving means prior to engagement of said image-toning roller and said photosensitive medium, thereby to reduce effect of said first moving force on movement of said image-toning roller.

20. An apparatus as set forth in claim 19, wherein said control means operates for deactivating said driving means, thereby to eliminate said torque and said second moving force from said image-toning roller, when said image-toning roller is at a second predetermined location separated by a second predetermined distance from the photosensitive medium while said moving means is moving said image-toning roller from the photosensitive medium, immediately following separation of said moving means from a structure carrying said image-toning roller.

* * * * *